US007213850B1

(12) United States Patent
Ruiz Díaz

(10) Patent No.: US 7,213,850 B1
(45) Date of Patent: May 8, 2007

(54) DOOR KNOB HOLDER

(76) Inventor: Angel Luis Ruiz Díaz, 2452 Vistamar St., Rincón, PR (US) 00677

( * ) Notice: Subject to any disclaimer, the term of this patent is extended or adjusted under 35 U.S.C. 154(b) by 0 days.

(21) Appl. No.: 11/271,182

(22) Filed: Nov. 10, 2005

(51) Int. Cl.
*E05C 17/54* (2006.01)

(52) U.S. Cl. ..... 292/338; 16/86 A; 16/82

(58) Field of Classification Search ..... 292/342, 292/343, 338, 339, DIG. 2, DIG. 15; 16/82, 16/86 A
See application file for complete search history.

(56) References Cited

U.S. PATENT DOCUMENTS 1,626,810 A * 5/1927 Gingras et al. ..... 292/17
1,739,940 A * 12/1929 Basinger ..... 292/246
1,921,568 A * 8/1933 Hasselberger ..... 292/344
2,452,461 A * 10/1948 Harris ..... 292/130
5,876,075 A * 3/1999 Barthelmess, Jr. ..... 292/247
6,863,319 B1 * 3/2005 Bentley ..... 292/262

* cited by examiner

*Primary Examiner*—Gary Estremsky
(74) *Attorney, Agent, or Firm*—Hoglund & Pamias PSC; Roberto J. Rios

(57) ABSTRACT

A door stop is attached to a wall at the same height as a doorknob. When the door is swung into an open position, the door stop is lifted. The doorknob passes under the door stop, which is then dropped so that it rests on the axel connecting the doorknob to the door. This operates to hold the door in place.

2 Claims, 6 Drawing Sheets

DOOR KNOB HOLDER

FIELD OF THE INVENTION

The invention relates generally to holding open a hinged door.

BACKGROUND OF THE INVENTION

Hinged doors are widely used in virtually every commercial and residential building. They are typically opened by a doorknob positioned along the side of the door opposite to the hinges. One example of is shown in FIGS. 1 and 2 of U.S. Pat. No. 5,771,533, titled "Door Stopping Device," issued to Wang Kuang-Pin on Jan. 30, 1998, which is incorporated by reference.

Various methods have been used to hold these hinged doors in an open position. The mentioned patent, for example, attaches a swinging leg with a rubber foot to the bottom of the door. When this leg is swung to the upper position, it does not interfere with the normal opening and closing of the door. When the leg is swung to the lower position, it prevents the door from closing. The operation and construction of this device are further detailed in the mentioned patent and illustrated in FIGS. 3–16. One disadvantage of this design is that it requires the apparatus to be attached to the door. This detracts from the overall appearance of the door. And, with time and use, the stress and strain applied by the apparatus can damage the door.

Another common method of holding a swinging door in an open position uses a simple hook and latch mechanism. A hook is attached to the bottom corner of the door and a corresponding latch is attached to the wall. When the door is in the fully open position, the hook engages the latch to hold it open. Like the above-mentioned design, however, the addition of a hook or latch on the bottom corner of the door detracts from its overall appearance and with use can damage the door.

SUMMARY OF THE INVENTION

It is an object of the invention to provide a simple mechanism for holding a door open.

It is another object of the invention to avoid adding hardware to the door itself.

According to one aspect of the invention, an apparatus is provided which is especially suitable for holding a door in an open position. The door has a knob connected to the door by an axel. The apparatus has an elongated base, a first and a second arm and a yoke. The elongated base has a first and a second end. The elongated base defines at least one hole for mounting the elongated base on a wall at a height approximately equal to the knob. The first arm has an inner and an outer end. The inner end of the first arm is pivotally attached to the first end of the base. The second arm has an inner and an outer end. The inner end of the second arm is pivotally attached to the second end of the base. The yoke is connected between the outer end of the first arm and the outer end of the second arm so that the yoke can be lifted above the knob as the door moves to a fully open position and then rested on the axel connecting the knob to the door to prevent the door from closing. A cushioned door stop mounted on the elongated base between the first end and the second end.

According to further aspects of the invention, the elongated base is constructed from a metal strap. The first end and the second end are bent at an approximately ninety degree angle so that the first end forms a first end plate and the second end forms a second end plate. The first arm, the second arm and the yoke are constructed from a single piece of wire. The yoke has a middle portion which is bent along a semi-circle and an outer portion on each side of the middle portion which extends horizontally from the semi-circle. The radius of the semi-circle is less than a radius of the knob and greater than a radius of the axel connecting the knob to the door.

According to another aspect of the invention, a doorknob holder is especially suitable for holding a door in an open position. The doorknob holder includes a base and a wire frame. The base is formed from a metal strap bent at each end at an approximately ninety degree angle. Each end defines a hole. The wire frame has a yoke and a pair of parallel arms extending from each end of the yoke. An end of each of the parallel arms is bent and passes through one of the holes in the ends of the elongated base so that the wire frame is pivotally attached to the elongated base. The yoke is configured to engage a doorknob by resting on an axel behind the doorknob to prevent the door from moving to a closed position.

According to further aspects of the invention, the yoke has a middle portion that forms the shape of a semicircle. The semicircle has a radius that is less than a standard doorknob but greater than a standard axel connecting a doorknob to a door.

According to another aspect of the invention, a door is held in an open position with a yoke. The yoke is pivotally connected to a wall at a height approximately equal to a height of a doorknob attached to the door. The yoke is lifted so that the yoke is positioned slightly above the doorknob. The door is swung into an open position so that the doorknob swings past the yoke. The yoke is dropped so that the yoke rests on an axel connecting the doorknob to the door.

BRIEF DESCRIPTION OF THE DRAWINGS

In the drawings and description, reference numerals are used to identify various parts. Some parts may appear in more than one drawing, and the same numeral is used to identify such parts.

DETAILED DESCRIPTION

Figure 1:
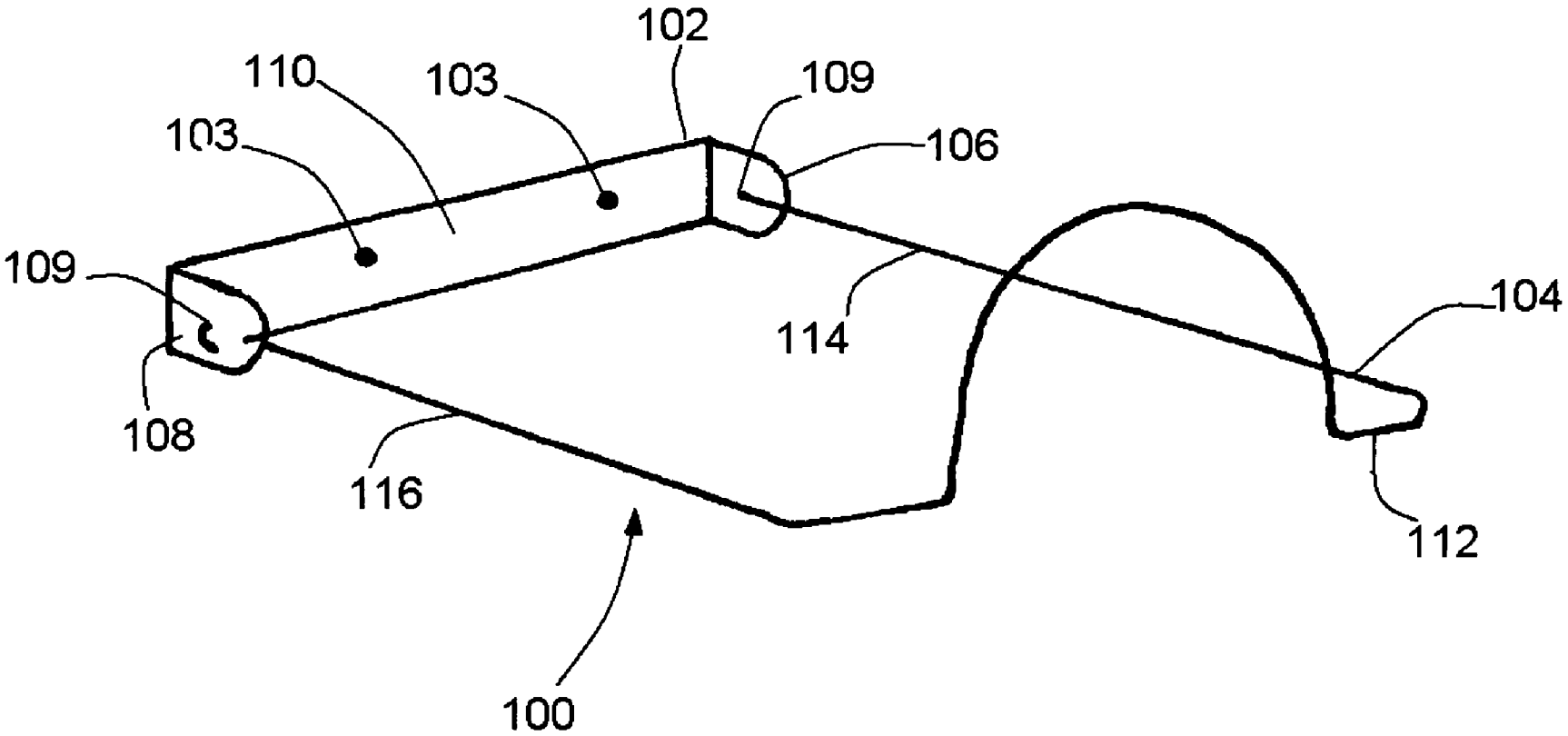
FIG. 1 is a perspective view of a doorknob holder 100.

A simplified door stop operates by engaging the doorknob. It avoids the need for attaching additional hardware to the door. It can be constructed using inexpensive materials. Specifically, turning to FIG. 1, a doorknob holder 100 is constructed from two parts. A metal strap forms the base 102 and a wire frame 104 forms the engagement mechanism. The base 102 is approximately three to four inches long. It defines a pair of holes 103 which are used for mounting. Each end of the metal strap forming base 102 is bent at a right angle to form end plates 106 and 108. Both of these extend approximately one half of an inch out away from the body 110. The end plates 106 and 108 have rounded corners.

The end plates 106 and 108 each define a hole 109 which is used to support the wire frame 104.

The wire frame 104 is formed from a single piece of strong, metal wire. It includes a yoke 112 and two arms 114 and 116. The yoke 112 is used to engage the doorknob. The middle portion of the yoke 112 is bent upward around a semi-circle and on either side of this semi-circle, the wire extends horizontally. The radius of this semi-circle is approximately one inch. The yoke 112 is shaped in this manner so that it will engage a doorknob.

Figure 2:
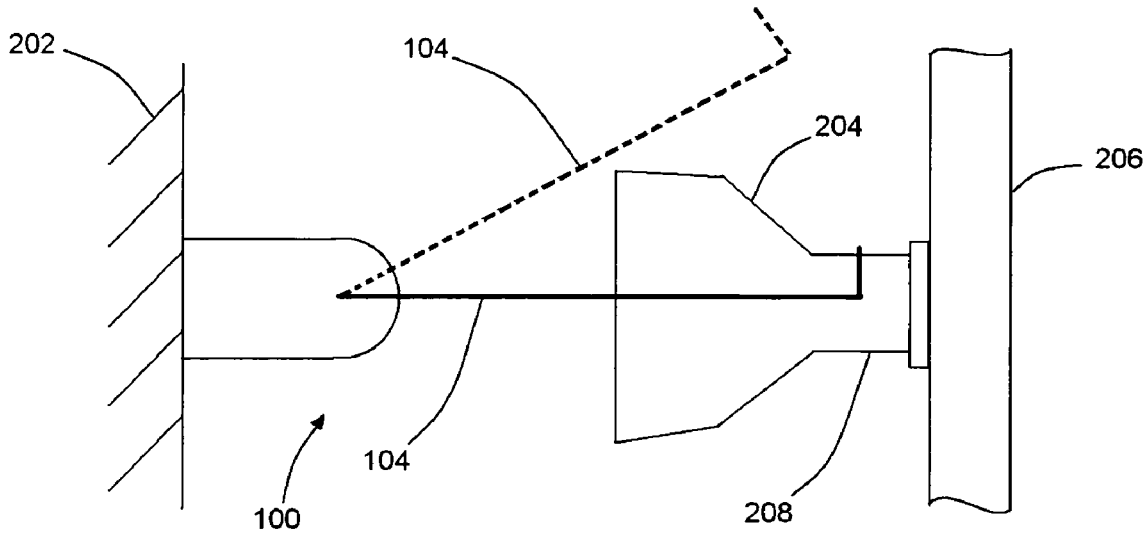
FIG. 2 is a side view of the doorknob holder 100 engaging a doorknob to hold a door in an open position.

As shown in FIG. 2, the middle portion of the yoke 112 will rest upon the shaft that connects a knob to a door. Because the radius of the curvature of the middle portion of the yoke 112 is smaller than that of a standard doorknob but greater than the radius of the shaft connecting the knob to the door, it will rest on the shaft between the knob and the door. When so positioned, it will prevent a door from closing because the doorknob is held back by the yoke 112.

Returning to FIG. 1, on each end of yoke 112, the wire is bent at a right angle to form arms 114 and 116. These extend back approximately two and a half inches to accommodate a standard doorknob. The back end of arms 114 and 116 are bent and pass through the holes in end plates 106 and 108. This forms a pivotal connection between the wire frame 104 and the base 102.

Turning again to FIG. 2, the doorknob holder 100 is secured to a wall 202 using the holes 103 in body 110. Screws can be used to attach the doorknob holder 100. It is positioned at the same height as the knob 204 on door 206. To hold the door 204 in place, the wire frame 104 is lifted to an elevated position (shown with dashed lines). When the doorknob is within the wire frame 104, it is released so that the yoke 112 rests on the axel 208 connecting the knob 204 to the door 206. In this position, the doorknob holder 100 prevents the door 206 from closing. To release the door, the wire frame 104 is again lifted and the door is closed moving the knob out of the holder 100.

Figure 3:
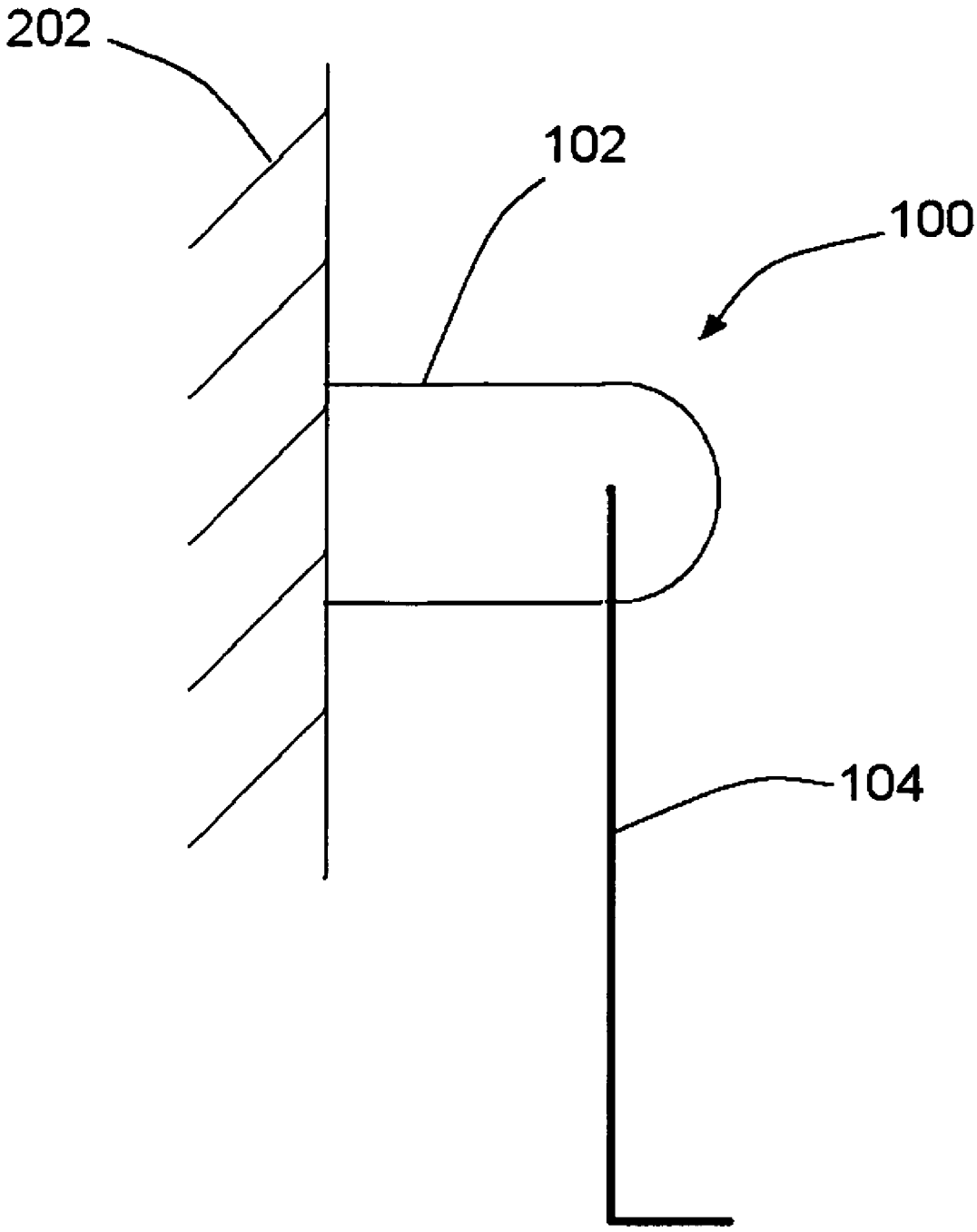
FIG. 3 is a side view of the doorknob holder 100 in a disengaged position.

Turning to FIG. 3, the doorknob holder 100 is shown in a released position. Here the wire frame 104 hangs down from the base 102.

Figure 4A:
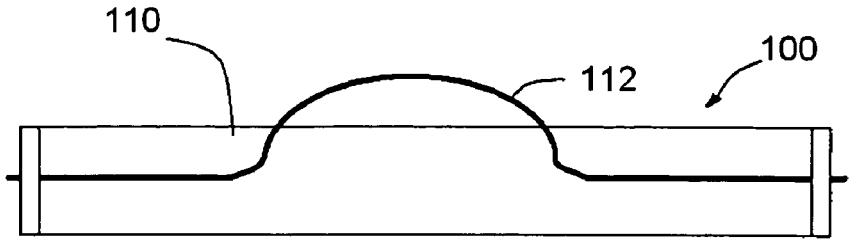
FIG. 4A is a front view of the doorknob holder 100.
Figure 4B:
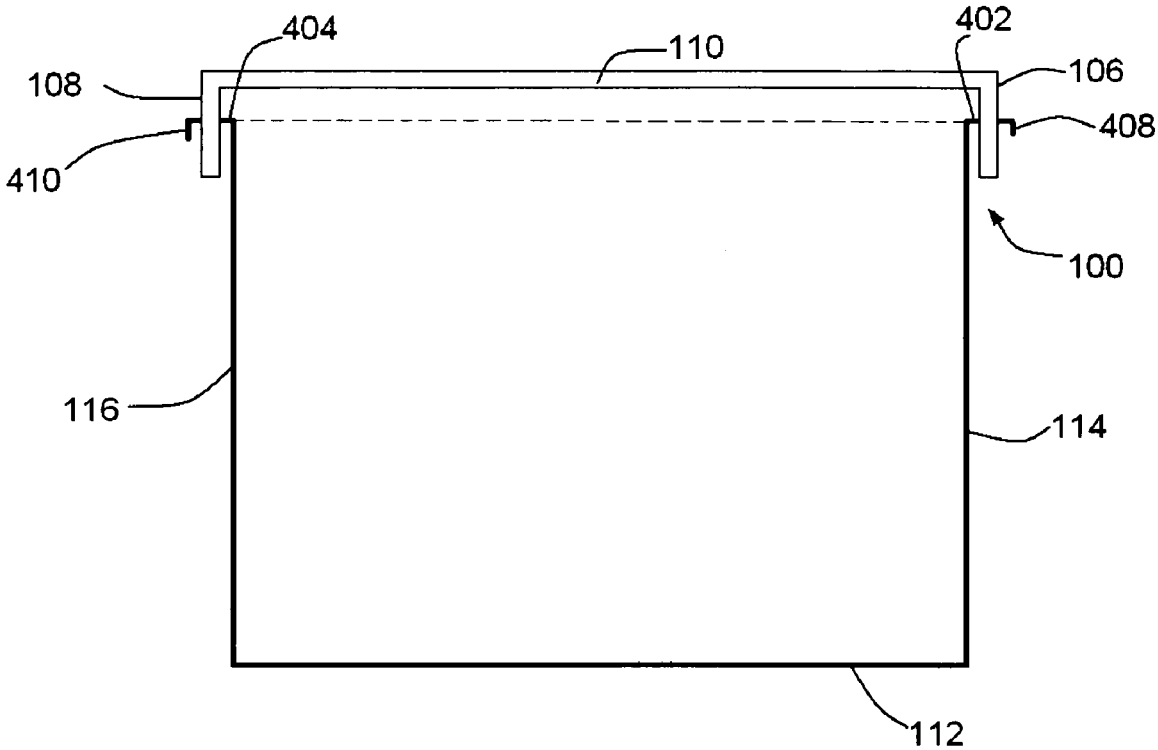
FIG. 4B is a top view of the doorknob holder 100.
Figure 4C:
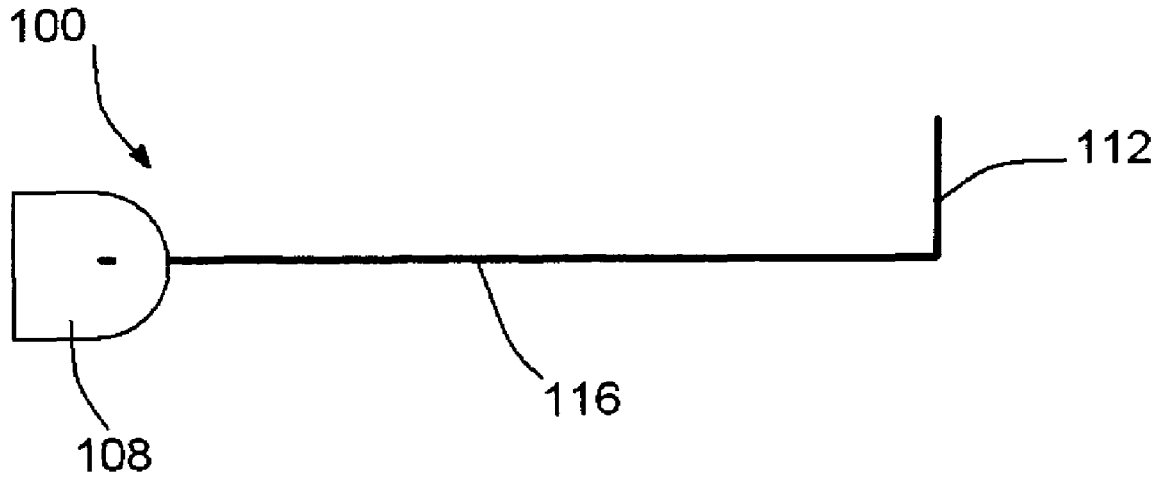
FIG. 4C is a side view of the doorknob holder 100.

Turning to FIGS. 4A, 4B and 4C, the doorknob holder 100 is shown from a front, top and side view, respectively. In FIG. 4B, the engagement between the arms 114 and 116 and the end plates 106 and 108 are seen most clearly. Each arm 114 and 116 is bent at its end at a right angle to form a pivot portion 402 and 404 of the respective arm. The pivot portions 402 and 404 are aligned along a common axis 406. The pivot portions 402 and 404 pass through the holes in the end plates 106 and 108, respectively. The terminal ends 408 and 410 are then bent back again at a right angle to prevent them from slipping out of the holes.

Figure 5:
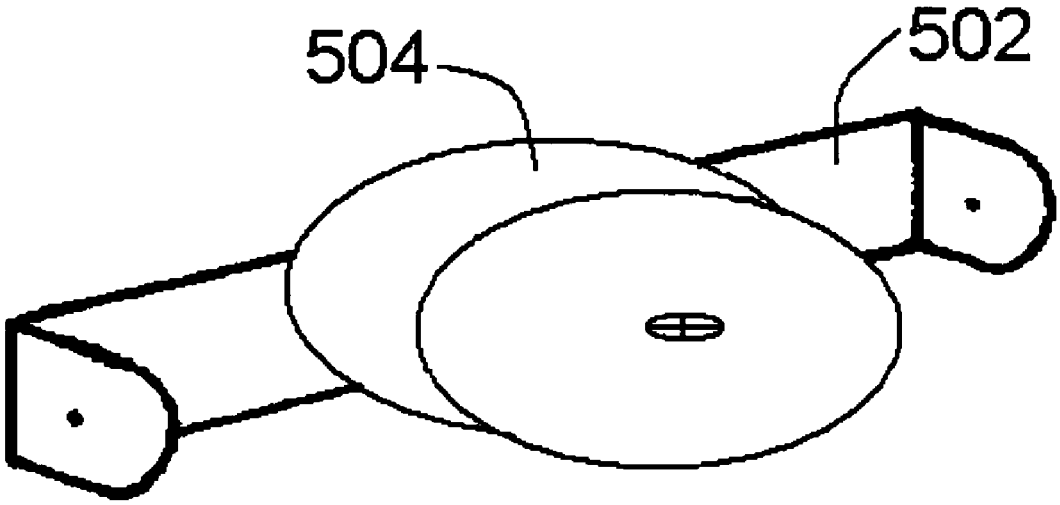
FIG. 5 is a perspective view of a base 502 for a doorknob holder that includes a cushioned doorknob stop 504.

Turning to FIG. 5, an alternative design for the base is shown. This base 502 is constructed in the same fashion as the one shown in FIG. 1, namely base 102, except that it includes a cushioned knob stop 504. The knob stop 504 is made of rubber or other pliable material. In this configuration, a single hole may pass though the knob stop 504 and base 502 for mounting. In addition, the arms of the wire frame would need to be lengthened an amount equivalent to the thickness of the knob stop 504.

Although the invention has been shown and described with reference to specific embodiments, those skilled in the art will appreciate that many modifications can be made. Likewise, although approximate dimensions have been given to accommodate a standard doorknob, these can be adjusted as appropriate. All such modifications are intended to be encompassed within the scope of the following claims.

I claim:

1. An apparatus especially suitable for holding a door in an open position, where the door has a knob connected to the door by an axel, the apparatus comprising:

an elongated base having a first and a second end, wherein the elongated base defines at least one hole for mounting the elongated base on a wall at a height approximately equal to the knob, wherein the elongated base is constructed from a metal strap, and wherein the first end and the second end are bent at an approximately ninety degree angle so that the first end forms a first end plate and the second end forms a second end plate;

a first arm having an inner and an outer end, wherein the inner end of the first arm is pivotally attached to the first end of the base;

a second arm having an inner and an outer end, wherein the inner end of the second arm is pivotally attached to the second end of the base;

a yoke connected between the outer end of the first arm and the outer end of the second arm so that the yoke can be lifted above the knob as the door moves to a fully open position and then rested on the axel connecting the knob to the door to prevent the door from closing, wherein the first arm, the second arm and the yoke are constructed from a single piece of wire, wherein the yoke has a middle portion which is bent along a semi-circle and an outer portion on each side of the middle portion which extends horizontally from the semi-circle, wherein the radius of the semi-circle is less than a radius of the knob and greater than a radius of the axel connecting the knob to the door; and a cushioned door stop mounted on the elongated base between the first end and the second end.

2. A doorknob holder especially suitable for holding a door in an open position comprising:

a base formed from a metal strap bent at each end at an approximately ninety degree angle, wherein each end defines a hole;

a wire frame having a yoke and a pair of parallel arms extending from each end of the yoke, wherein an end of each of the parallel arms is bent and pass through one of the holes in the ends of the elongated base so that the wire frame is pivotally attached to the elongated base, and wherein the yoke is configured to engage a doorknob by resting on an axel behind the doorknob to prevent the door from moving to a closed position, wherein the yoke has a middle portion that forms the shape of a semicircle, and wherein the semicircle has a radius that is less than a standard doorknob but greater than a standard axel connecting a doorknob to a door; and a cushioned door stop attached to the base.

* * * * *